United States Patent [19]

Rümmer

[11] 4,073,383

[45] Feb. 14, 1978

[54] DEVICE FOR DISPLAYING CARPET PATTERNS OR THE LIKE

[76] Inventor: Jürgen Rümmer, Industriestr. 12, 8602 Troisdorf, Germany

[21] Appl. No.: 659,007

[22] Filed: Feb. 18, 1976

[51] Int. Cl.[2] ..... A47F 3/11

[52] U.S. Cl. ..... 211/1.5; 40/473; 211/45; 211/166

[58] Field of Search ..... 211/1.5, 209, 45, 166; 40/30, 33

[56] References Cited

U.S. PATENT DOCUMENTS

| | | | |
|---|---|---|---|
| 2,157,199 | 5/1939 | Doering | 211/1.5 X |
| 2,443,320 | 6/1948 | Meyer et al. | 211/1.5 X |
| 2,544,404 | 3/1951 | Ward | 40/65 |
| 2,985,975 | 5/1961 | Pike et al. | 40/30 |

FOREIGN PATENT DOCUMENTS

| | | | |
|---|---|---|---|
| 342,621 | 2/1931 | United Kingdom | 40/30 |

*Primary Examiner*—Roy D. Frazier
*Assistant Examiner*—Robert W. Gibson, Jr.
*Attorney, Agent, or Firm*—Max Fogiel

[57] ABSTRACT

The specification describes a device adapted to rotate in both directions about a vertical axis for displaying patterns or carpets or rugs. The patterns are carried on telescoping rings which can be moved vertically between a position in which substantially all rings lie one inside the other and an upper display position.

7 Claims, 4 Drawing Figures

DEVICE FOR DISPLAYING CARPET PATTERNS OR THE LIKE

BACKGROUND OF INVENTION

1. Field to which invention relates

The invention relates to a columnar device, adapted to rotate about a vertical axis in both directions of rotation, for the display of samples of carpets or the like.

2. The prior art

On selecting carpets or fitted carpets the customer must be provided with an impression of the appearance of the carpet so that he can make a judicious choice. If the carpets are piled one on top of the other on the ground, it will be necessary on displaying the carpets to tuck back the carpets at least partly so that the customer can examine all individual carpet patterns. Therefore, a proposal has already been made to provide mechanical means for this, which make possible an examination of the individual carpets which can be selected without it being necessary to tuck back or draw upwards the carpets by hand. For example there has been the proposal to combine the carpet patterns or samples to form a single band and to present this band continuously to cumstomers. This device however suffers from the short-coming that the individual patterns must firstly be combined together before display, something which is carried out for example by sewing together or stapling together. If it should now be required to replace one of the patterns, for example owing to a change in the patterns available, it will be necessary to remove or cut out the connecting thread and it will then be necessary to sew in the new pattern to be displayed. The prior art device furthermore suffers from a certain disadvantage in that the customer must always examine all patterns just as they are displayed one after the other. It is not possible or at any rate not readily possible to display to the customer a particular pattern, for example one which has previously been selected. Added to this there is the disadvantage that the examination by eye and selection of the individual patterns is comparatively time-consuming.

SUMMARY OF INVENTION

Therefore one of the aims of the present invention is that of providing a device for displaying carpet patterns with which the above-mentioned short-comings can be substantially avoided and in the case of which it is possible, more particularly, to change individual patterns rapidly and without any substantial difficulties.

This aim is achieved in the case of a device of the above-mentioned type in that several cylindrical rings carrying the carpet patterns on their peripheral parts are arranged with a stepped increase in diameter coaxially between an axially fixed upper ring with the smallest diameter and an axially fixed upper ring with the largest diameter, which are adapted to be raised and lowered by means of a lifting mechanism one after the other or selectively in an axial direction. In the case of one embodiment of the invention the lifting mechanism consists of a cord guiding means constructed in the manner of a block and tackle, in the case of which in the upper part motor-driven cord drums and in the center part pulley wheels with fixed axes are arranged, while the rings adapted to shift in the axial direction are also connected with pulley wheels, over which the cord, attached to the shifting ring with the largest diameter, is passed. Preferably three synchronously running cord drums are provided whose axes coincide with the sides of an equilateral triangle inscribed in the stationary ring with the smallest diameter and which are associated respectively with a set of pulley wheels. The synchronous running of the cord drums is achieved by the feature that the cord drums are connected for transmission of power with each other by means of bevel gear wheels. The individual rings are preferably made up of two end rings arranged at the ends and axially extending connecting struts connecting the rings and dividing up peripheral portions of the rings into compartments for the carpet patterns or the like. In accordance with a further feature of the invention there is the provision of supporting the device axially via a rolling element bearing. The individual rings can in accordance with a further embodiment of the invention be provided with guide means for making sliding engagement with each other.

Finally, the lifting mechanism can also comprise hydraulically or pneumatically driven driving cylinders in the case of which each respective driving cylinder is arranged to cooperate with one of the rings adapted to be raised and lowered.

LIST OF SEVERAL VIEWS OF DRAWINGS

The invention will now be described with reference to the accompanying drawings.

DESCRIPTION OF PREFERRED EMBODIMENTS

Figure 1:
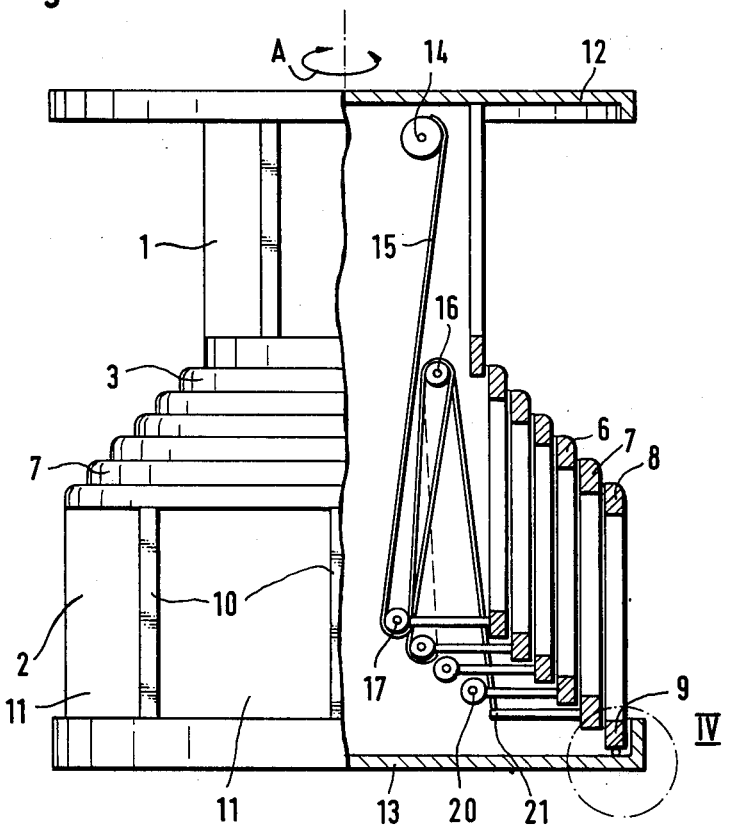
FIG. 1 shows a side view of the device in accordance with the invention diagrammatically, half of the device being shown in section.

As can clearly be seen from FIG. 1 the device for displaying the individual carpet patterns is constructed generally in the form of a column. The device consists mainly of an axially fixed ring with the smallest diameter, which is constructed generally cylindrical.

This ring 1 is provided in the upper part of the device. In the lower part of the device for displaying the carpet patterns or the like there is also a further cylindrical ring 2 which is axially fixed. Between the rings 1 and 2 several cylindrical rings 3 to 7 are arranged coaxially with respect to the rings 1 and 2. Each of the rings 1 to 7 consists mainly of two end rings 8 and 9 arranged at the ends and struts 10 which run in the axial direction and connect the end rings 8 and 9 with each other. The struts divide up the peripheral part of each of the rings 1 to 7 into individual compartments 11, in which the individual carpet or the like patterns can be hung. Furthermore, the device has a lid-like platform 12 and at the bottom it is supported by a base plate 13 also resembling in platform. The rings 1 to 7 respectively increase in diameter in steps from the smallest ring to the largest, the ring 1 having the smallest diameter, while the ring 2 has the largest diameter and the rings 3 to 7 are arranged between the two rings 1 and 2 and increase in steps in diameter. The whole device can be turned in the two directions of rotation as indicated by arrow A.

Figure 3:
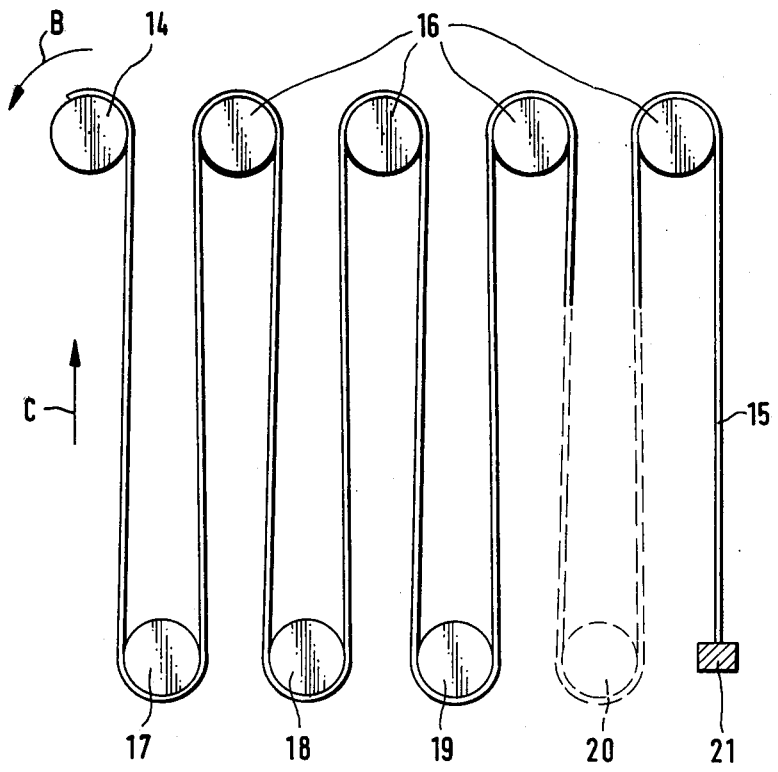
FIG. 3 shows diagrammatically the cord arrangement of the lifting mechanism, resembling blocks and tackle used in the device in accordance with the invention.

The rings 3 to 7 are, in contrast to the rings 1 and 2, not arranged stationarily in the axial direction and can be raised and lowered by means of a lifting mechanism in the axial direction. Particulars of this lifting mechanism will be provided below with reference to the right-hand half of FIG. 1. It will be seen that in the upper part of the device a cord or rope drum 14 is arranged, with which a cord 15 can be wound up and unwound again. The cord drum 14 is adapted to be driven by means of an electric motor or the like, though this is not shown specifically in FIG. 1. The cord 15 which can be wound up and unwound from the cord drum 14 cooperates with a pulley wheel or sheave set, which respectively comprises a pulley 16 with a stationary axis in the center part of the device and with pulley wheels or sheaves 17 to 20 connected respectively with the cylindrical rings 3 to 6. The pulley wheels 17 to 20 are connected by means of suitable linkages in a rigid manner with the rings 3 to 6. Finally, the free end of the cord or rope 15 is connected in a fixed manner with the ring 7 having the largest diameter and which can be moved axially. This fixed connection of the cord 15 with the ring 7 is denoted by reference numeral 21. In order to provide an explanation of the means for raising and lowering the individual rings attention is called in particular to FIG. 3. FIG. 3 shows diagrammatically the arrangement of the cord drum 14 and of the individual pulley wheels 16 (though it has not been mentioned in connection with FIG. 1, it is possible to provide several relatively offset pulley wheels 16 in the center part) and of the pulley wheels 17 to 20 connected with the cylindrical rings. As denoted by reference numeral 21 the cord 15 is connected fixedly with the axially displaceable ring 7 with the largest diameter. If now the cord drum 14 is turned in the direction of the arrow B, the cord 15 will be wound up in the direction of the arrow C. On being so wound up it will entrain the pulley wheel 17 and accordingly the ring 3 connected with it. As soon as the pulley wheel 17 arrives in an upper position, in which the ring abuts for example against the plate 12, the pulley wheel 18 will be displaced in the direction of the arrow 7 etc. until finally by virtue of the attachment 21 the ring 7 is raised axially. On turning the cord drum 14 against the direction of the arrow B the individual rings are lowered one after the other. Instead of the five rings shown in the embodiment and adapted to be displaced axially as denoted by reference numerals 3 to 7 it is also possible to provide more such rings. In the case of an embodiment of the invention constructed the number of the axially shifting rings amounts to twelve. FIG. 3 shows in broken lines the cord between the pulley wheels 16 and the pulley wheel 20 in a symbolic manner so as to indicate that the number of pulley wheels and therefore the number of cylindrical rings connected with them can be increased in accordance with specific space available.

Figure 4:
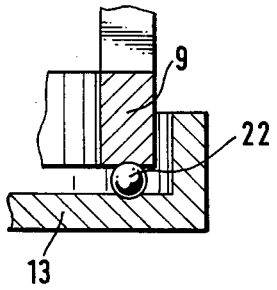
FIG. 4 shows a detail of the subject matter of the application on a larger scale.

The individual cylindrical rings are guided by sliding guides so that they can easily be shifted in the axial direction. The whole device is supported, as is indicated particularly clearly in FIG. 4, by means of a rolling element bearing 22 on the base plate 13 so that as a result it is easily possible to turn the device as indicated by the arrow A. Furthermore, it is possible, though this is not shown specifically in FIG. 4, to provide a radial rolling element bearing in order to make possible satisfactory movement of the device in a radial direction as well. On the other hand, this radial rolling element bearing can be omitted, for the axial bearing 22 also provides for a certain radial guiding effect.

Figure 2:
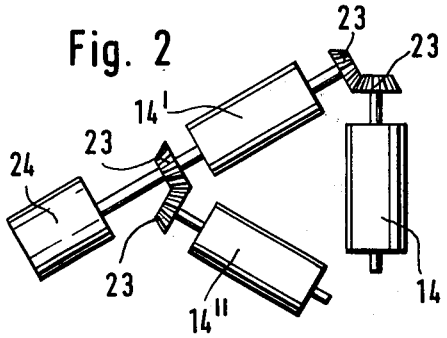
FIG. 2 shows a plan view of the arrangement of the cord drums arranged in the upper part of the device in accordance with the invention.

In connection with FIG. 1 it was only stated that one cord drum 14 is provided. It is convenient however — in order to make possible even raising of the individual rings 3 to 7 — to provide several cord drums 14. FIG. 2 shows diagrammatically the arrangement of three cord drums 14, 14′ and 14″, which have their axes coinciding with the sides of an equilateral triangle. This triangle which is not shown in detail in FIG. 2 is drawn within the cylindrical ring 1 with the smallest diameter. The trunnions of the cord drums 14, 14′ and 14″ have respective bevel gear wheels 23 arranged on them, which mesh with each other and accordingly bring about synchronous rotation of the individual cord drums 14 to 14″. The drive is for example by means of an electric motor 24, which can be in the form of a gear motor. The driving force of the motor 24 is transmitted via the bevel gear wheels 23 evenly to all cord drums 14, 14′ and 14″. The arrangement shown in FIG. 2 of the cord drums 14 to 14″ provides in connection with the pulley wheel set associated with each of the cord drums 14 to 14″ an even raising of the individual cylindrical rings. In this respect a pulley wheel set consists of one or more pulley wheels 16 with fixed axes and pulley wheels 17 to 20 connected respectively with the rings 3 to 7, as is represented in FIG. 1.

The lifting mechanism for raising and lowering the cylindrical rings adapted to shift axially can be constructed also as a hydraulically or pneumatically operated driving cylinder (FIG. 5). In this case each ring adapted to move axially is provided with a driving cylinder 100 to 104, the cylinder for example being arranged stationarily while its driving piston 110 to 114 is pivotally connected with the respective ring.

With the device in accordance with the invention it is possible to provide for a rapid synoptic examination of a selection of patterns of fitted carpets, carpets, rugs or the like. The device in accordance with the invention is constructed robustly and compactly and only requires a small amount of floor area. In the case of an embodiment constructed it is possible for example to display on a floor area of approximately 1.5 square meters 110 carpet patterns with a format of 80 × 50 cm. The device in accordance with the invention can be turned in one direction during the raising of the individual cylindrical rings. It is however also possible to reverse the direction of rotation after raising one ring in each case. In the case of an embodiment constructed it has been found that owing to the height, that is to say the axial extent of the device in accordance with the invention twisting of the electrical leads connected with the electric motors or the like does not lead to any damage of the leads.

I claim:

1. A columnar device rotatable about a vertical axis in both directions of rotation for the display of samples of carpets or the like comprising a plurality of cylindrical rings with an upper fixed ring and a lower fixed ring and shiftable rings between said upper and lower rings for carrying carpet patterns on their peripheral parts and arranged with a stepped increase in diameter coaxially between said axially fixed upper ring with the smallest diameter and an said axially fixed lower ring with the largest diameter, and lifting means for selectively raising and lowering the shiftable cylindrical rings carrying said carpet patterns in an axial direction, said device having a fixed height between said fixed upper ring and said fixed lower ring, said height being substantially less than the sum of individual heights of said cylindrical rings.

2. A device in accordance with claim 1, wherein said lifting means comprises a cord, cord guiding means having a block and tackle with an upper part including motor-driven cord drums carried on said upper ring, a center part of pulley wheels with fixed axes carried by said shiftable rings; the rings being shiftable in an axial direction; said cord being connected to the shifting ring with the largest diameter and passing over said pulley wheels to raise and lower said shiftable rings upon actuation of said motor-driven drums.

3. A device in accordance with claim 2, including three synchronously running cord drums having axes coinciding with sides of an equilateral triangle inscribed in the fixed upper ring; each said synchronously running cord drums being associated with a set of pulley wheels.

4. A device in accordance with claim 3, including gear means, said synchronously running cord drums being connected with each other by said gear means for driving each other.

5. A device in accordance with claim 1, wherein each ring has two end rings arranged at the ends thereof, and axially extending connecting struts connecting the end rings and dividing up peripheral portions of the rings into compartments for carpet patterns or the like.

6. A device in accordance with claim 1 including rolling bearing means for supporting said device in the axial direction.

7. A device as defined in claim 1, wherein said lifting means comprises a cord, cord guiding means having a block and tackle with an upper part of motor-driven cord drums and a center part of pulley wheels with fixed axes shiftable in axial direction, said cord being connected to the shifting ring with the largest diameter and passing over pulley wheels, the other shiftable rings being connected to the pulley wheels over which said cord passes, three synchronously running cord drums having axes coinciding with sides of an equilateral triangle inscribed in the fixed upper, each synchronously running cord drum being associated with a set of pulley wheels, gear means, said synchronously running cord drums being connected with each other by said gear means for driving each other, each ring having two end rings arranged at the ends thereof, axially extending connecting struts connecting the end rings and dividing up peripheral portions of the rings into compartments for carpet patterns, rolling bearing means for supporting said device, said height being substantially twice to 2½ times the height of one ring.

* * * * *